US009655455B2

(12) United States Patent
Barnett

(10) Patent No.: US 9,655,455 B2
(45) Date of Patent: May 23, 2017

(54) CHAIR

(71) Applicant: Barnett Engineering Ltd, Wrexham (GB)

(72) Inventor: Stephen Barnett, Llangollen (GB)

(73) Assignee: Barnett Engineering Ltd, Wrexham (GB)

( * ) Notice: Subject to any disclaimer, the term of this patent is extended or adjusted under 35 U.S.C. 154(b) by 170 days.

(21) Appl. No.: 14/166,938

(22) Filed: Jan. 29, 2014

(65) Prior Publication Data

US 2014/0210249 A1 Jul. 31, 2014

(30) Foreign Application Priority Data

Jan. 31, 2013 (GB) ..... 1301751.2

(51) Int. Cl.
*A47C 9/00* (2006.01)
*A47C 4/54* (2006.01)

(52) U.S. Cl.
CPC ..... *A47C 9/002* (2013.01); *A47C 4/54* (2013.01)

(58) Field of Classification Search
CPC ..... A47C 9/002
USPC ..... 297/452.41, 440.22
See application file for complete search history.

(56) References Cited

U.S. PATENT DOCUMENTS 5,145,474 A * 9/1992 Moore ..... A63B 26/003 482/146
6,070,943 A * 6/2000 Guery-Strahm ..... A47C 3/16 297/440.1
6,309,331 B1 * 10/2001 Raymond ..... A61H 15/00 482/132
D471,371 S * 3/2003 Chiu ..... D6/366
6,702,388 B1 * 3/2004 Chiu ..... A47C 4/54 297/217.1
6,702,726 B2 * 3/2004 Lin ..... A63B 21/154 446/220
6,730,005 B1 5/2004 Liao
6,746,372 B2 * 6/2004 Hsu ..... A47C 9/002 482/123
7,044,558 B2 * 5/2006 Chiu ..... A47C 4/54 297/217.1
D536,542 S * 2/2007 Chiu ..... D6/352
7,588,522 B2 * 9/2009 Heitzman ..... A47C 4/54 297/195.11

(Continued)

FOREIGN PATENT DOCUMENTS

DE 29614431 1/1997
FR 2360323 3/1978

(Continued)

*Primary Examiner* — David E Allred

(74) *Attorney, Agent, or Firm* — Defillo & Associates Inc.; Evelyn A. Defillo

(57) ABSTRACT

A chair comprising a seat assembly and a support assembly is disclosed. The seat assembly has a deflectable body disposed about an axis that provides resilient convex seating surface. The support assembly retains the seat assembly and allows the seat assembly to rotate about its axis and additionally allows the seat assembly to rotate to cause limited tilt displacement of the axis from a neutral alignment. The support assembly includes biasing means that serve to urge the seat assembly towards the neutral alignment when the seat assembly is displaced from the neutral alignment.

13 Claims, 7 Drawing Sheets

(56) References Cited

U.S. PATENT DOCUMENTS

| | | | | |
|---|---|---|---|---|
| 7,691,036 | B1 * | 4/2010 | Julian | A61H 1/0292 482/110 |
| 7,901,339 | B2 * | 3/2011 | Schechter | A63B 21/00047 482/142 |
| 8,056,976 | B1 * | 11/2011 | Polk | A47C 3/029 297/258.1 |
| 8,177,732 | B2 * | 5/2012 | Einav | A61H 1/0274 601/23 |
| 2005/0261114 | A1 | 11/2005 | Heitzman | |
| 2012/0220431 | A1 | 8/2012 | Signorile | |
| 2012/0299357 | A1 * | 11/2012 | Newman | A47C 4/54 297/452.41 |
| 2014/0217788 | A1 * | 8/2014 | Norwood | B60R 21/233 297/216.12 |

FOREIGN PATENT DOCUMENTS

| | | |
|---|---|---|
| FR | 2859640 | 3/2005 |
| JP | 2007181730 | 7/2007 |

* cited by examiner

CHAIR

BACKGROUND TO THE INVENTION

Field of the Invention

This invention relates to chairs. In particular, it relates to a chair that promotes the health and fitness of a user.

Summary of the Prior Art

It is widely recognized that a sedentary lifestyle can give rise to health problems. Yet, an increasing number of people have an occupation that involves sitting for an extended period. Many alternatives to a conventional office chair have been proposed, with the general aim of encouraging a user to adopt a posture that imposes less strain on the lower back of the occupant. Some people have chosen to abandon the use of a chair altogether, and have chosen instead to sit on an exercise ball (also known as a "Swiss ball"). To sit upon such a ball requires some effort to maintain balance, which ensures that a sitting person's spine does not remain immobile and helps to strengthen the person's core muscles. However, use of a ball can be inconvenient since they tend not to remain in one place when unoccupied. They also do not allow a user to move freely across a floor, as does a conventional office chair supported on castor wheels.

There is therefore a demand to provide a chair that enables a user to sit for an extended period with fewer detrimental effects as compared with a conventional chair.

SUMMARY OF THE INVENTION

To this end, this invention provides a chair comprising a seat assembly and a support assembly, in which the seat assembly has a body disposed about an axis that provides resilient convex seating surface; wherein the support assembly retains the seat assembly and allows the seat assembly to rotate about its axis and additionally allows the seat assembly to rotate to cause limited tilt displacement of the axis from a neutral alignment and the support assembly includes biasing means that serve to urge the seat assembly towards the neutral alignment when the seat assembly is displaced from the neutral alignment.

Such a chair allows the body much of the freedom of movement of an exercise ball placed on a floor, yet constrains it against bodily movement as with a ball rolling across a floor.

Preferably, rotation about the axis is free—that is, it can be continuous and take place with little friction.

The body may be formed of flexible material, which may for example be maintained in shape by being inflated pneumatically. Alternatively, the body may be formed of resilient material, such as in the form of a self-supporting shell, or it may be a solid body, for example being formed from a foamed plastic material.

In a typical arrangement, when the support assembly is placed on flat, horizontal support such as a floor, in the neutral alignment, the axis is vertical.

In preferred embodiments, the body is pneumatically inflatable. For example, it may be substantially spherical. This latter arrangement can conveniently be implemented by use of an exercise ball (such as that known as a "Swiss ball"). Alternatively, the deflectable body may be made of resiliently deformable material, such as a foam. The biasing means may include a plurality of elongate elastomeric members that are connected between the seat assembly and the support assembly to apply a balanced force to the seat assembly when the axis is in the neutral alignment.

In preferred embodiments, the body is a generally spherical ball of elastomeric material. The ball may be retained by a shell that provides a bearing surface that interacts with the support assembly. The shell may be part-spherical to closely surround and support the ball. The support assembly may include a plurality of bearings, each of which has, for example, a spherical element that is in contact with the shell.

The seat assembly typically carries a limiting element that makes contact with part of the support assembly once the axis has been displaced from the neutral alignment by a predetermined maximum limit. Preferably, the limiting element is formed of a resiliently deformable material such that movement of the seat assembly is stopped gradually when its displacement reaches the maximum limit.

Advantageously, the support assembly is carried on a plurality of castor assemblies whereby it can be displaced across a surface on which it is supported, in much the same manner as a conventional office chair.

IN THE DRAWINGS

DETAILED DESCRIPTION OF THE PREFERRED EMBODIMENT

Figure 4:
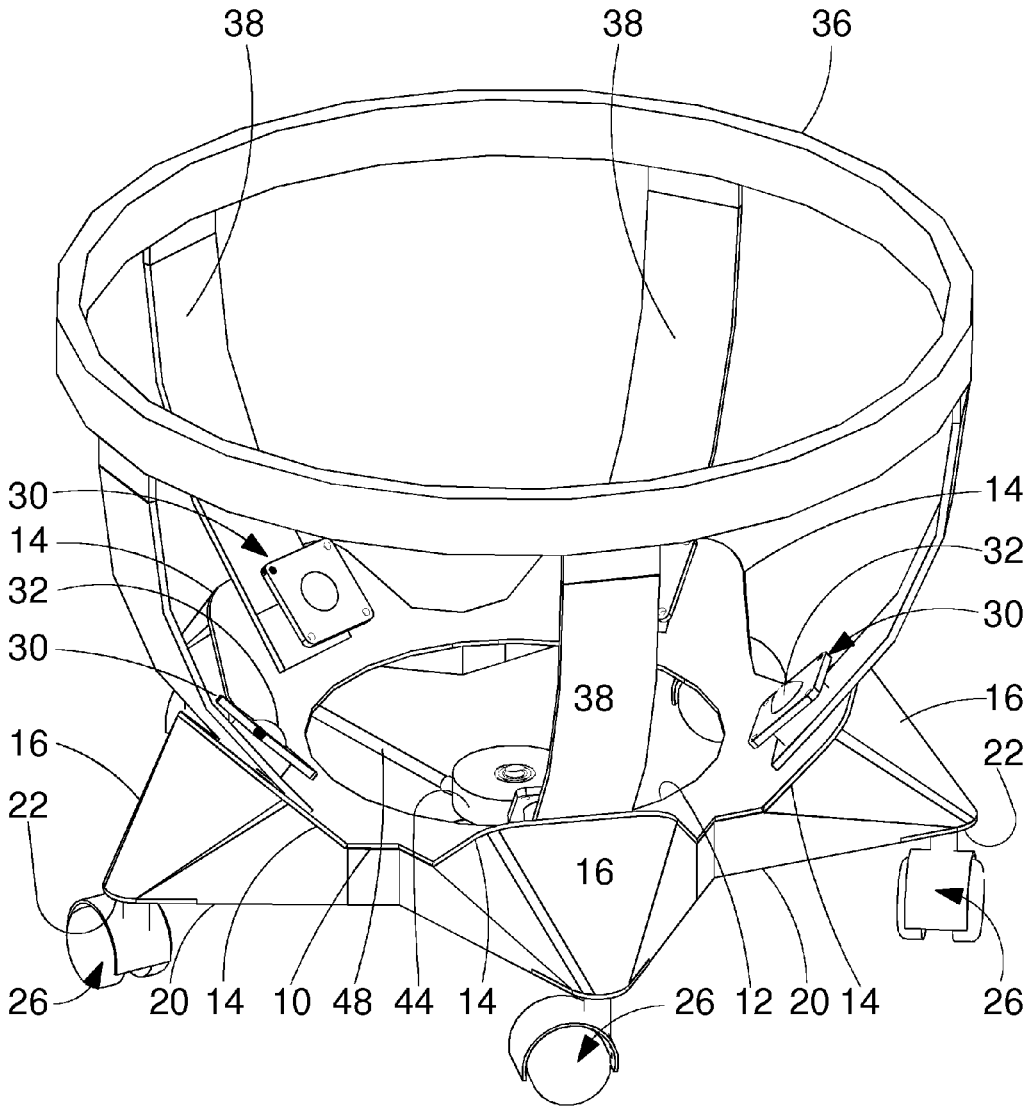
FIG. 4 shows a base assembly of the seat of FIGS. 1 to 3.
Figure 5:
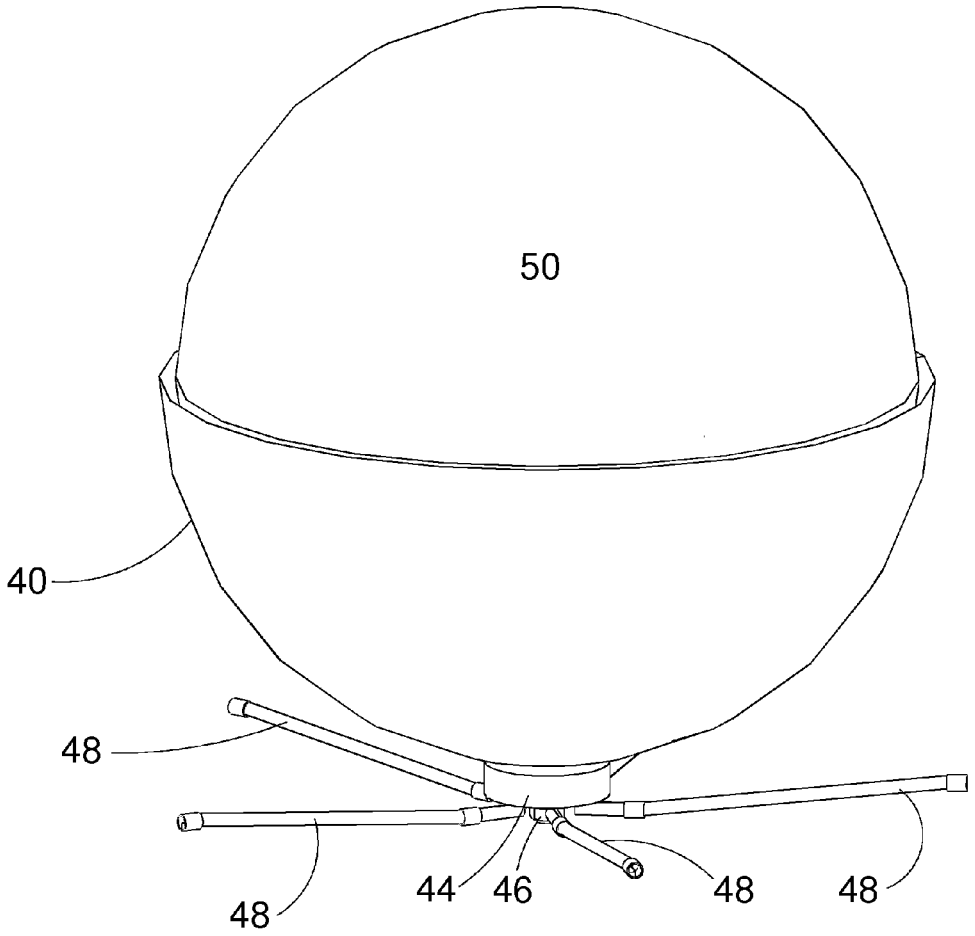
FIG. 5 shows a seat assembly of the seat of FIGS. 1 to 3.
Figure 6:
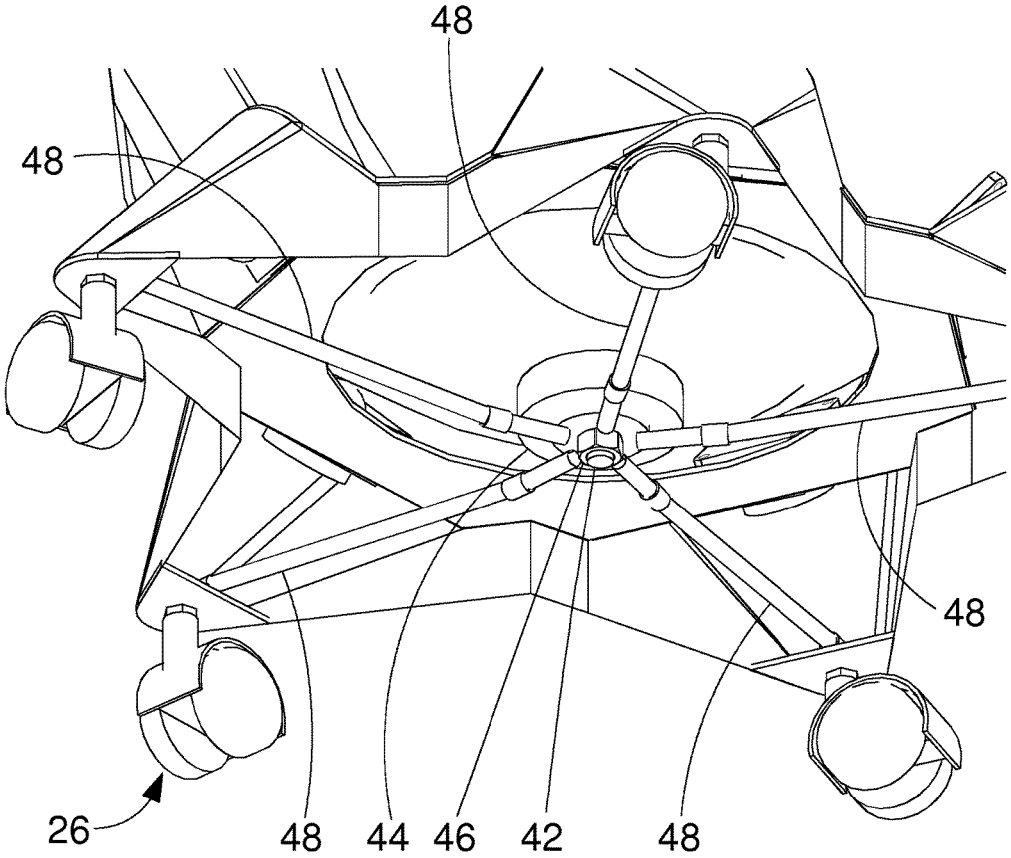
FIG. 6 shows a lower part of the seat of FIGS. 1 to 3 in more detail.
Figure 7:
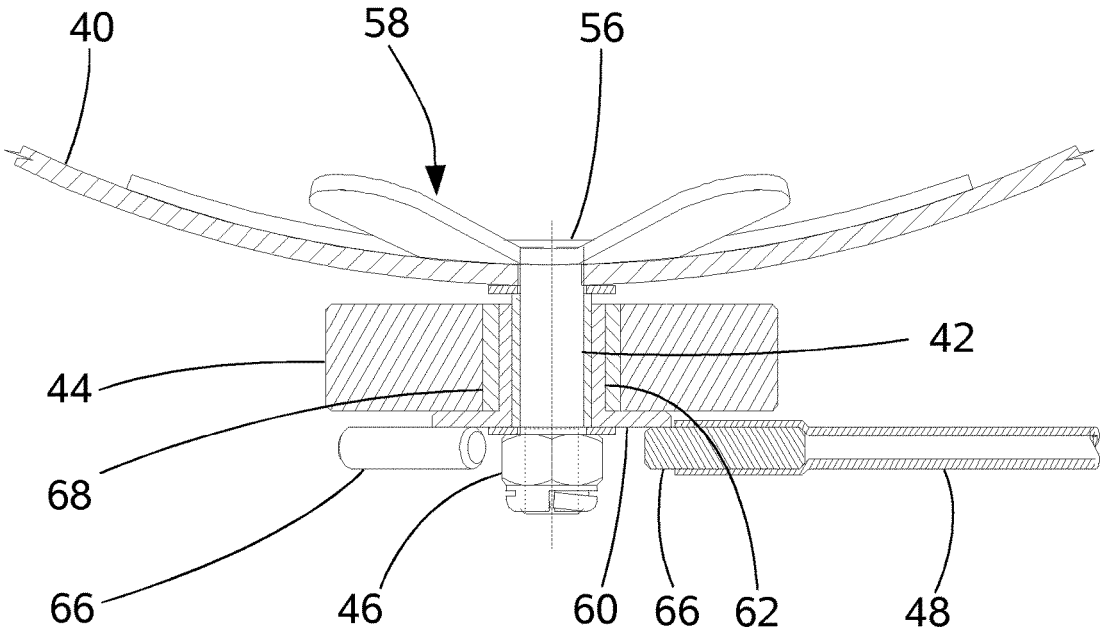
FIG. 7 is a cross-sectional view of a lower part of the seat of FIGS. 1 to 3.

With reference to the drawings, a chair being an embodiment of the invention comprises a support assembly (FIG. 4) and a seat assembly (FIG. 5).

The support assembly comprises a base plate 10 that has five-fold rotational symmetry about an axis that is vertical during normal use of the chair. A circular aperture 12 is formed through the base plate 10, centered on the vertical axis.

Figure 1:
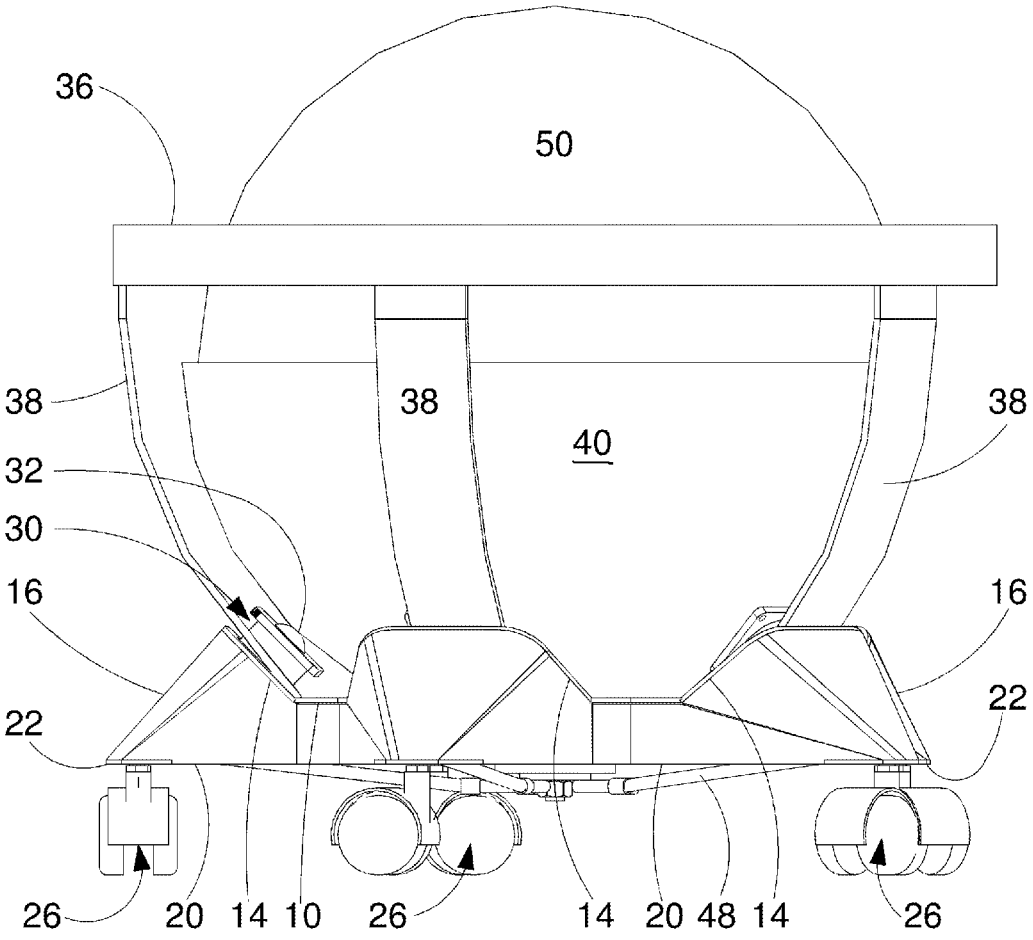
FIGS. 1, 2 and 3 are side, top and bottom views of a chair being an embodiment of the invention.
Figure 2:
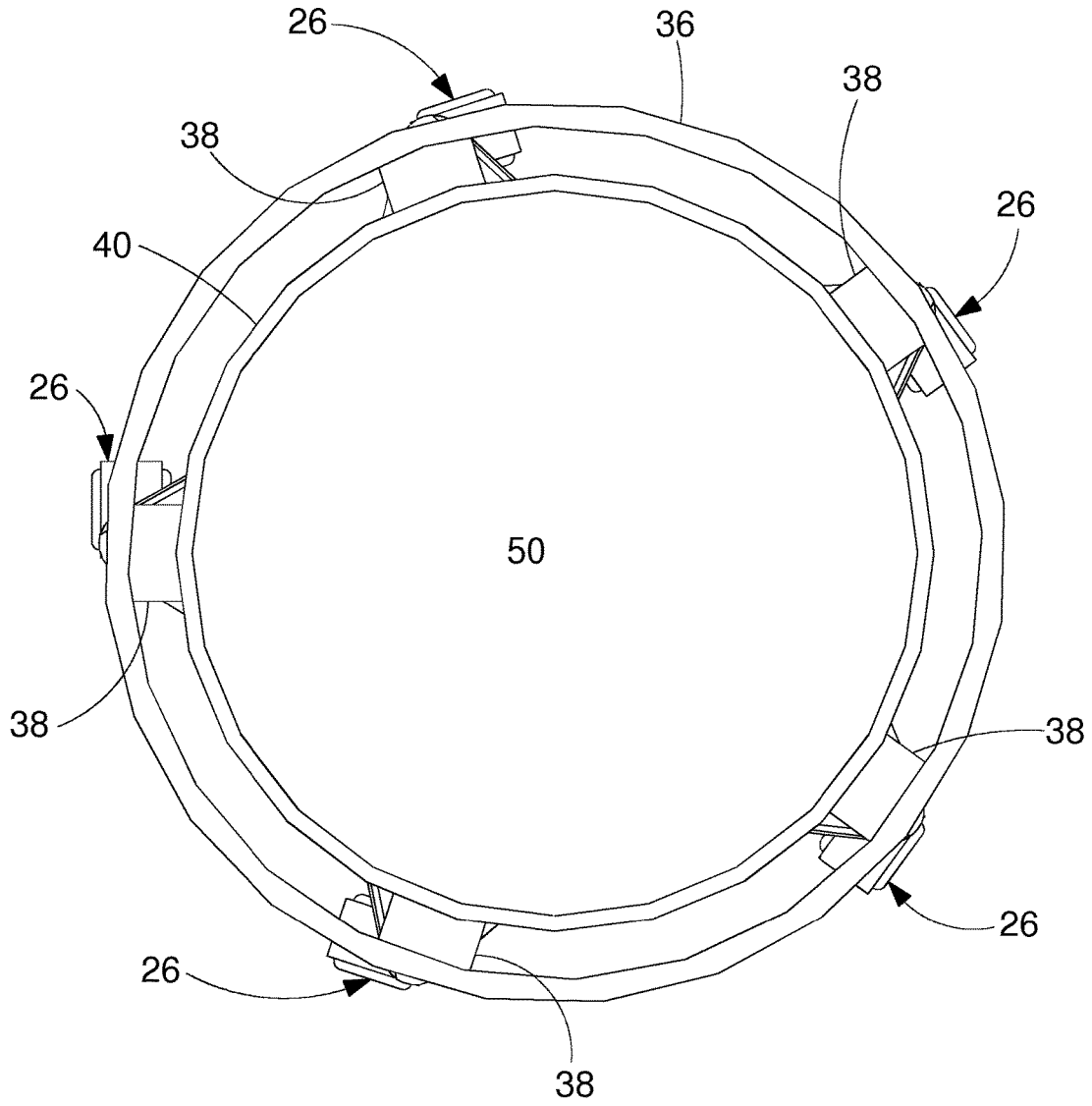
Figure 3:
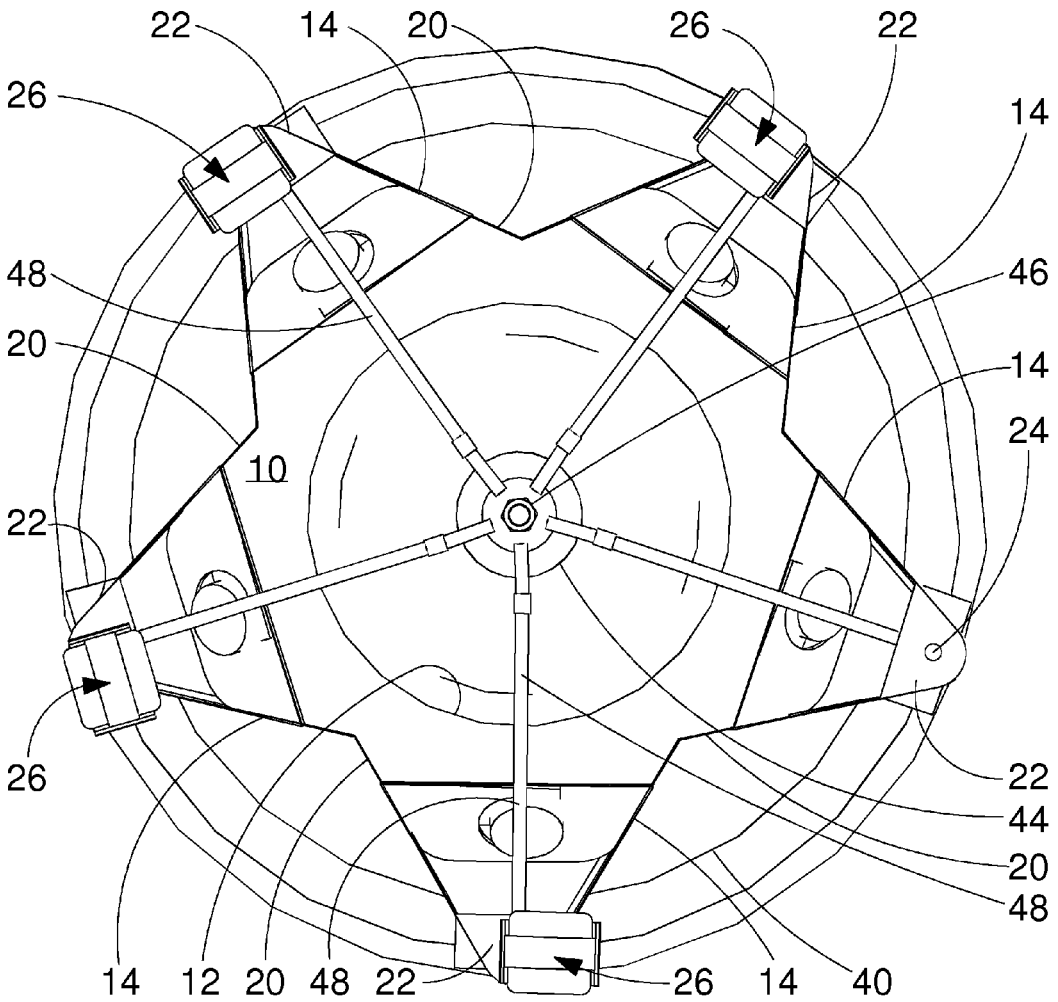

The support assembly includes five castor and bearing regions spaced equally around the vertical axis. Each of such regions includes a sloping section 14 of the base plate 10 that extends upwardly from the base plate 10 at approximately 45° from the vertical axis. Each castor and bearing region further includes a support plate 16 that slopes downwardly away from the axis from a peripheral part of the sloping section 14. A web 20 extends downwardly from an edge region of the plate 16 (including the sloping regions 14) to interconnect the support plates 16. A mounting plate 22 extends horizontally and is secured to a lower portion of the support plate 16 and a peripherally outer part of the web 20. An aperture 24 is formed through the mounting plate 22, and a castor wheel 26 (one being omitted from FIG. 3 for clarity) is secured through the aperture 24.

Each castor and bearing region further includes a bearing assembly 30. Each bearing assembly has a ball 32 that is captive within the bearing assembly but is free to rotate in any direction with respect to it. A portion of the ball 32 projects from the bearing assembly 30 towards the vertical axis vertically angled from the axis by approximately 45°.

A guard ring 36 formed as a very squat cylinder is centered on the vertical axis. The guard ring 36 is supported on five support members 38, each of which extends upwardly from a respective castor and bearing region. The support members 38 are curved, such that close to the castor and bearing region, they extend at approximately 45° to the vertical axis, and where they join the guard ring 36, they are approximately vertical.

The support assembly, in this embodiment, is fabricated from steel. However, it could alternatively be formed from plastic material, for example by molding, or a combination of materials.

The seat assembly comprises a generally hemispherical shell 40, formed, in this embodiment, from a durable material such as acrylic. The shell 40 is supported on the five balls 32 of the bearing assemblies 30, such that it presents an upwardly-directed circular opening. The bearing assemblies allow the shell 40 to rotate about its center in any direction. An externally-threaded stud 42 projects through an aperture in the shell 40. The stud 42 has an axis that passes through the center of the opening of the shell 40 and a head 56 that is of diameter greater than that of the aperture. A load spreading plate 58 is disposed between the head 56 and the shell 40 to ensure that load from the stud 42 is not concentrated in the immediate vicinity of the aperture. In this embodiment, the load spreading plate 58 has a central region from which a plurality of fingers extend radially, the fingers being curved to confirm with the inner surface of the shell 40.

A connection member is carried on the stud 42. The connection member comprises an annular flange 60 from which extends a tubular bush 62, the bush 62 being carried as a close fit for rotation on the stud 42 and extending between the flange 60 and the head 56. Five radially-extending tubes 66 are secured to the flange 60, spaced equally around it. A nut 46 retains the connection member on the stud 42. A boss 44 of elastomeric material is carried on the stud 42. The boss 44 has an axial bush 68 that can rotate upon the bush 62 on the connection member, where it is retained by the flange 60. Thus, both the boss 44 and the connection member can rotate with respect to one another and with respect to the shell 40.

Each tube 66 of the connection member is connected to a castor and bearing region by a respective connecting element 48. Each connecting element 48 comprises an elongate element that is capable of elastic extension, for example, a length of latex rubber tube.

Within the shell 40 there is a ball 50 of pneumatically inflated flexible material. This may be constituted by a ball of the type used in physical exercising, known as a "Swiss ball" of "fitness ball". The relative sizes of the shell 40 and the ball 50 are chosen such that the ball is a close fit within the shell 40. A portion of the shell 40 adjacent to the opening may be formed with a radially outward curve (not shown in the drawings) to reduce the risk of the ball 50 being damaged by the material of the shell 40. In alternative embodiments, the ball may be formed of a resilient material which may be integral with the shell 40.

While unoccupied, the connecting elements 48 will pull upon the boss 44 to draw it towards the vertical axis of the seat—the neutral position of the seat assembly. Thus, the ball 50 will present an upwardly-directed hemispherical surface upon which a user can sit. In the neutral position, the boss 44 projects partially through the aperture 12 in the base plate 10. Once a user sits upon the surface of the ball 50, any component of the user's weight that is not coaxial with the vertical axis of the seat will tend to cause the seat assembly to rotate on the bearing assemblies 30 about the center of the ball 50. Once such rotation takes place, the forces applied by the connecting elements 48 to the boss 44 will no longer be balanced, the imbalance giving rise to a restoring force that acts to tend to restore the seat assembly towards the neutral position. The ultimate limit to which the seat assembly can rotate is determined by the boss 44 coming into contact with the edge of the aperture 12 within the base plate 10.

It will be seen that the seat assembly is also free to rotate about an axis that is coaxial with the stud 42. This axis is vertical when it is in the neutral position, and is tilted as the seat assembly is tilted away from the neutral position. Because the boss 44 is carries on the stud 42 by a bearing, such rotation is not inhibited when the boss 44 makes contact with the edge of the aperture 12.

The elastomeric stiffness of the connecting elements 48 determines the magnitude of the restoring force, and this can be adjusted to suit the needs of a particular user. In general, the lighter the restoring force (with respect to the user's body weight), the more effort a user will have to exert in order to stay upright on the ball. Therefore, a user may start using the chair with the connecting elements 48 configured to apply a relatively great restoring force. Then, over time, as the user becomes accustomed to the chair, and gains strength in his or her core muscles, the restoring force can be reduced such that the users strength continues to develop.

What is claimed is:

1. A chair comprising:

a seat assembly; and a support assembly adapted to be supported on a floor;

wherein the seat assembly has a body disposed about an axis that provides a resilient convex seating surface, the seat assembly has a shell at least partially surrounding the body and supported on the support assembly, and the shell has a boss extending radially outward from and connected to the shell for rotation of the body and the shell;

wherein the support assembly retains the seat assembly when occupied by a user, the seat assembly is supported by the support assembly above the floor on which the support assembly is supported and is free to rotate about its axis and additionally allows the seat assembly to tilt to cause limited tilt displacement of the axis from a neutral alignment;

the support assembly including a biasing device urges the seat assembly towards the neutral alignment when the seat assembly is tilted from the neutral alignment;

wherein the biasing device includes a plurality of elongated elastomeric members that are connected by respective first ends of the elongated elastomeric members to the boss of the seat assembly and by respective second ends of the elongated elastomeric member to respective locations on the support assembly to apply a balanced force to the seat assembly when the axis is in a neutral alignment.

2. A chair according to claim 1, in which when the support assembly is placed on a flat, horizontal support, in the neutral alignment, the axis is substantially vertical.

3. A chair according to claim 1 in which the body is pneumatically inflatable.

4. A chair according to claim 1 in which the body is formed from a resiliently-deformable material.

5. A chair according to claim 1 in which the body is substantially spherical.

6. A chair according to claim 1 in which the body is a generally spherical ball of elastomeric material.

7. A chair according to claim 6 in which the ball is retained by the shell that provides a bearing surface that interacts with the support assembly.

8. A chair according to claim 7 in which the shell is part-spherical to closely surround and support the ball.

9. A chair according to claim 7 in which the support assembly comprises a plurality of bearings, each of which has a spherical element that is in contact with the shell.

10. A chair according to claim 1, in which the seat assembly carries a limiting element that makes contact with part of the support assembly once the axis has been displaced from the neutral alignment by a predetermined maximum limit.

11. A chair according to claim 10, in which the limiting element is formed of a resiliently deformable material such that movement of the seat assembly is stopped gradually when its displacement reaches the maximum limit.

12. A chair according to claim 1, in which the support assembly is carried on a plurality of castor assemblies whereby it can be displaced across a surface on which it is supported.

13. A chair comprising:

a seat assembly;

a support assembly;

wherein the support assembly includes:

a base plate, a plurality bearing assemblies spaced equally around the base plate, each bearing assembly including a projecting ball projecting from the bearing assembly towards a vertical axis of the support assembly, each projecting ball being free to rotate in any direction;

a castor connected to each one of the bearing assemblies;

a plurality of sloping sections extending upwardly from the base plate;

a support plate extending downwardly away from a peripheral part of each sloping section;

wherein the seat assembly comprises:

a semi spherical shell supported on the ball of each bearing assembly, the semi spherical shell rotates about its center in any direction;

a user contact ball located inside the semi-spherical shell;

a stud protruding away from a bottom end of the semi spherical shell;

a connection member carried on the stud;

a boss carried on the stud, the connection member and the boss rotate with respect to each other and with respect to the semi spherical shell;

connecting elements having a first end connected to the boss and a second end connected to one of the castors;

the support assembly retains the seat assembly when occupied by a user, the seat assembly is supported by the support assembly and is free to rotate about its axis and additionally allows the seat assembly to tilt to cause limited tilt displacement of the axis from a neutral alignment.

* * * * *